United States Patent [19]

Auerbach

[11] Patent Number: 4,888,938

[45] Date of Patent: Dec. 26, 1989

[54] ENVELOPE THROAT OPENING BLADE

[75] Inventor: David R. Auerbach, West Redding, Conn.

[73] Assignee: Pitney Bowes Inc., Stamford, Conn.

[21] Appl. No.: 292,133

[22] Filed: Dec. 30, 1988

[51] Int. Cl.[4] ..... B65B 5/06; B65B 39/12; B65B 43/26

[52] U.S. Cl. ..... 53/569; 53/260; 53/266 A

[58] Field of Search ..... 53/52, 255, 259, 260, 53/266 A, 381 R, 569, 570

[56] References Cited

U.S. PATENT DOCUMENTS

| | | | |
|---|---|---|---|
| 3,381,447 | 5/1968 | Ash et al. | 53/570 |
| 3,936,993 | 2/1976 | Dorer | 53/266 A |
| 4,633,644 | 1/1987 | Haroutel et al. | 53/266 A X |

*Primary Examiner*—Robert L. Spruill
*Assistant Examiner*—Linda B. Johnson
*Attorney, Agent, or Firm*—Charles R. Malandra, Jr.; Melvin J. Scolnick; David E. Pitchenik

[57] ABSTRACT

Apparatus for inserting documents into an envelope. The apparatus includes: a housing frame; a constantly turning roller rotatably mounted to the frame; a lower, rotatable belt mounted to the frame and trained over the roller, the lower belt having an upper reach; and an upper, rotatable belt mounted to the frame, the upper belt having a lower reach engagable with the upper reach of the lower belt for transporting the documents. The apparatus further includes: a device for separating the front wall from the back wall of the envelope, the device located on the downstream side of the upper and lower belts; an envelope throat opening blade mounted to the frame on the downstream side of the upper and lower belts; and a pivotable trigger cam connected to the blade and engageable with the constantly turning roller and the documents, whereby when the documents engage the cam, the roller is engaged by the cam to thereby drive the opening blade into the throat of the envelope.

10 Claims, 7 Drawing Sheets

7
62
64
66
68
70
72
74
76
18
19
20
59
7

ENVELOPE THROAT OPENING BLADE

BACKGROUND OF THE INVENTION

The instant invention relates to apparatus for inserting sheet materials into envelopes, and more particularly to a device for opening an envelope for the insertion of a collation being ¼ inch or more in thickness.

Envelope stuffing machine, such as those shown in U.S. Pat. Nos. 4,169,341 and 4,337,609, both assigned to the assignee of the instant application, generally include: a conventional structure for delivering an envelope, with its address panel oriented upwardly and its flap opened, to a registration gate at an enclosure inserting station; conventional structure for timely opening the delivered envelope, including a plurality of fingers known in the art as stripper fingers, which are insertable into the throat of the envelope for opening the same; and conventional structure for inserting an enclosure into the opened envelope. Typically, the envelope opening structure includes a plate which acts as a ledge upon which the flap of the envelope is located when it is delivered to the inserting station. Moreover, one or more rigid finger members, known in the art as depressor fingers, are fixedly attached to the framework of the inserter apparatus and disposed in overhanging relationship with respect to the envelope's address panel, for depressing the body of the envelope downwardly against the resistance afforded by the envelope flap ledge to thereby partially open the throat of the envelope to facilitate insertion of the stripper fingers into the envelope.

Operators of the conventional inserters have experienced difficulties with them due to the aforesaid fixed depressor fingers tending to prevent delivery of the envelope to the registration gate. As a result, many operators have been bending the depressor fingers away from the path of travel of the envelope to ensure delivery to the registration gate, as a result of which the force exerted on the envelope by the depressor fingers is reduced and the envelope is insufficiently depressed to permit entry of the stripper fingers into the envelope for opening the same. Accordingly, misfeeds resulting from improper envelope registration and failure to open the envelopes have been found to be directly attributable to the provision of the fixed depressor fingers. The aforesaid U.S. Pat. No. 4,337,609 taught a partial solution to the problems generated by fixed depressor fingers y providing movable depressor fingers which normally hold the depressor fingers out of the path of travel of the envelope and for moving the depressor fingers into engagement with the envelope when a connective solenoid is enabled.

However, problems still persist using the movable depressor fingers. Thus, the assignee of instant invention provided an envelope opening apparatus in connection which a belt device for the feeding of enclosures which employs only a pair of orbital stripper claws and does not require the use of any depressor fingers, fixed or movable, and the substantial amount of apparatus associated therewith. The aforementioned envelope opening apparatus is described in co-pending application Ser. No. 242,566 filed Sept. 12, 1988. Experience has now shown that insert collations of ¼ inch thickness or greater have a greater tendency than thinner collations to cause jams on their being inserted into an envelope. Accordingly, the instant invention provides an envelope throat opening blade which allows collations of ¼ inch thickness or greater to be inserted by the use of belts into envelopes without a greater tendency for the creation of jams than with thinner collations, while at the same time not impeding the processing of thinner and/or lighter collations. The instant invention is particularly helpful when the collation is being fed into light or thin envelopes.

SUMMARY OF THE INVENTION

The instant invention provides apparatus for inserting documents into an envelope. The apparatus includes: a housing frame; a constantly turning roller rotatably mounted to the frame; a lower, rotatable belt mounted to the frame and trained over the roller, the lower belt having an upper reach; and an upper, rotatable belt mounted to the frame, the upper belt having a lower reach engagable with the upper reach of the lower belt for transporting the documents. The apparatus further includes: a device for separating the front wall from the back wall of the envelope, the device located on the downstream side of the upper and lower belts; an envelope throat opening blade mounted to the frame on the downstream side of the upper and lower belts; and a pivotable trigger cam connected to the blade and engagable with the constantly turning roller and the documents, whereby when the documents engage the cam, the roller is engaged by the cam to thereby drive the opening blade into the throat of the envelope.

DETAILED DESCRIPTION

Figure 1:
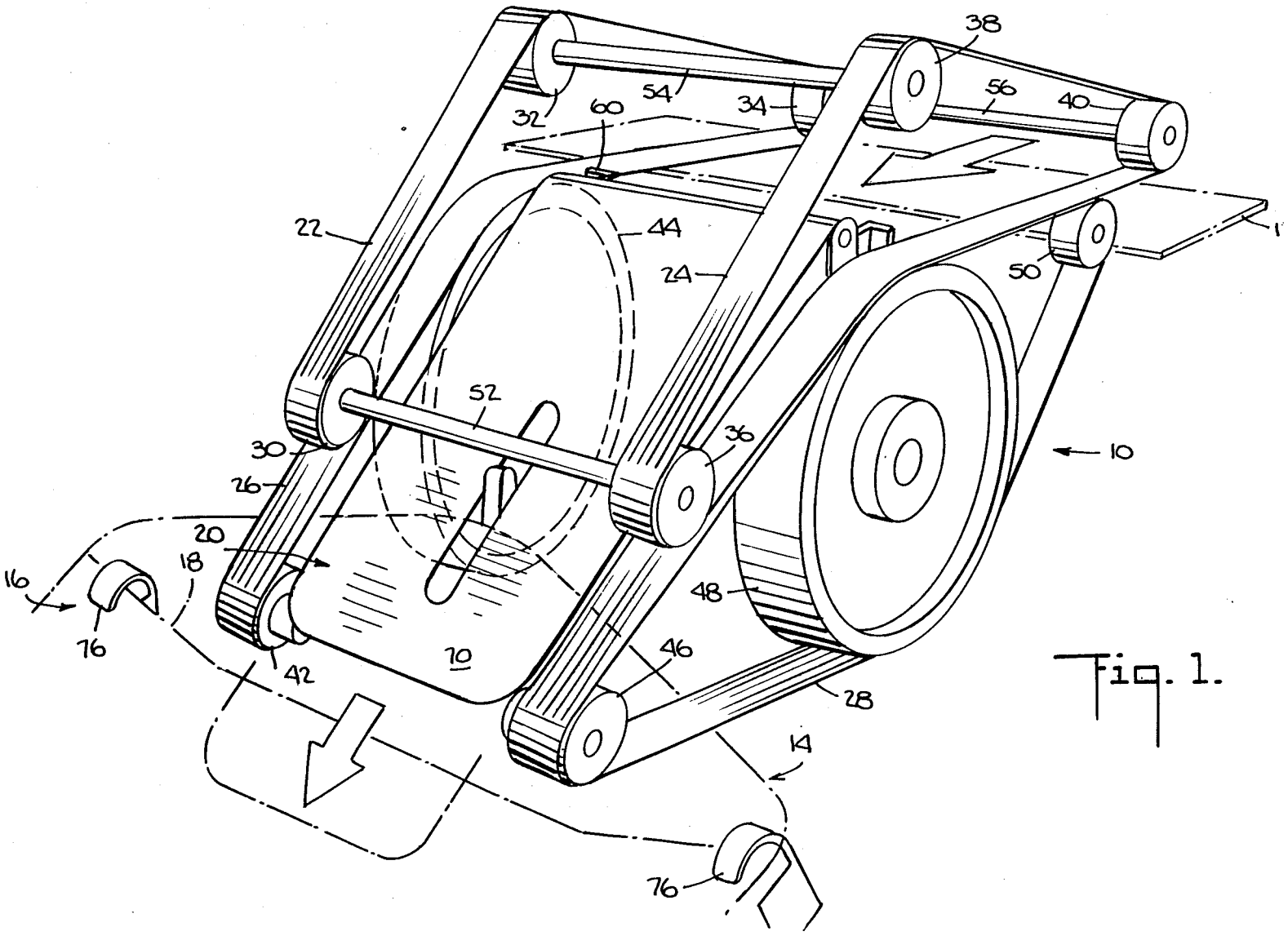
FIG. 1 is an overall perspective view of an inserting system in accordance with the instant invention.

In describing the preferred embodiment of the instant invention, reference is made to the drawings, wherein there is seen on FIG. 1 a belt and pulley inserting system generally designated 10 for feeding a collation 12 consisting of one or more documents into an envelope 14 having a front panel 16, a back panel 18 and flap 20.

A pair of constantly moving upper belts 22 and 24 cooperate with a pair of constantly moving lower belts 26 and 28 respectively to advance the collation 12 from document feeders (not shown) located upstream to the envelope 14 located at the inserting position, seen in FIG. 1. The upper belt 22 is trained over three pulleys 30, 32 and 34 while the upper belt 24 is trained over three pulleys 36, 38 and 40. The lower belt 26 is trained over a pulley 42, a roller 44 and a second pulley not shown, while the lower belt 28 is trained over two pulleys 46 and 50 and a roller 48. The pulleys 30 and 36 are mounted on a shaft 52; the pulleys 32 and 38 are mounted on a shaft 54; the pulleys 34 and 40 are mounted on a shaft 56; the large rollers 44 and 48 are fixedly mounted on a shaft 58; and the pulleys 42 and 46 are rotatably mounted on a pair of lower belt arms 59 (see FIG. 4).

The inserting system 10 includes a pair of pivotable trigger cams 60, and a pair of light, cam return springs 64. Each cam 60 and each return spring 64 is mounted on an arm 62 which is rotatably mounted on the shaft 58. The lower belt arms 59 are biased upwardly by means of a pair of springs 66 in order to provide a driving force to the collation 12 to effect insertion into the envelope 14.

Figure 2:
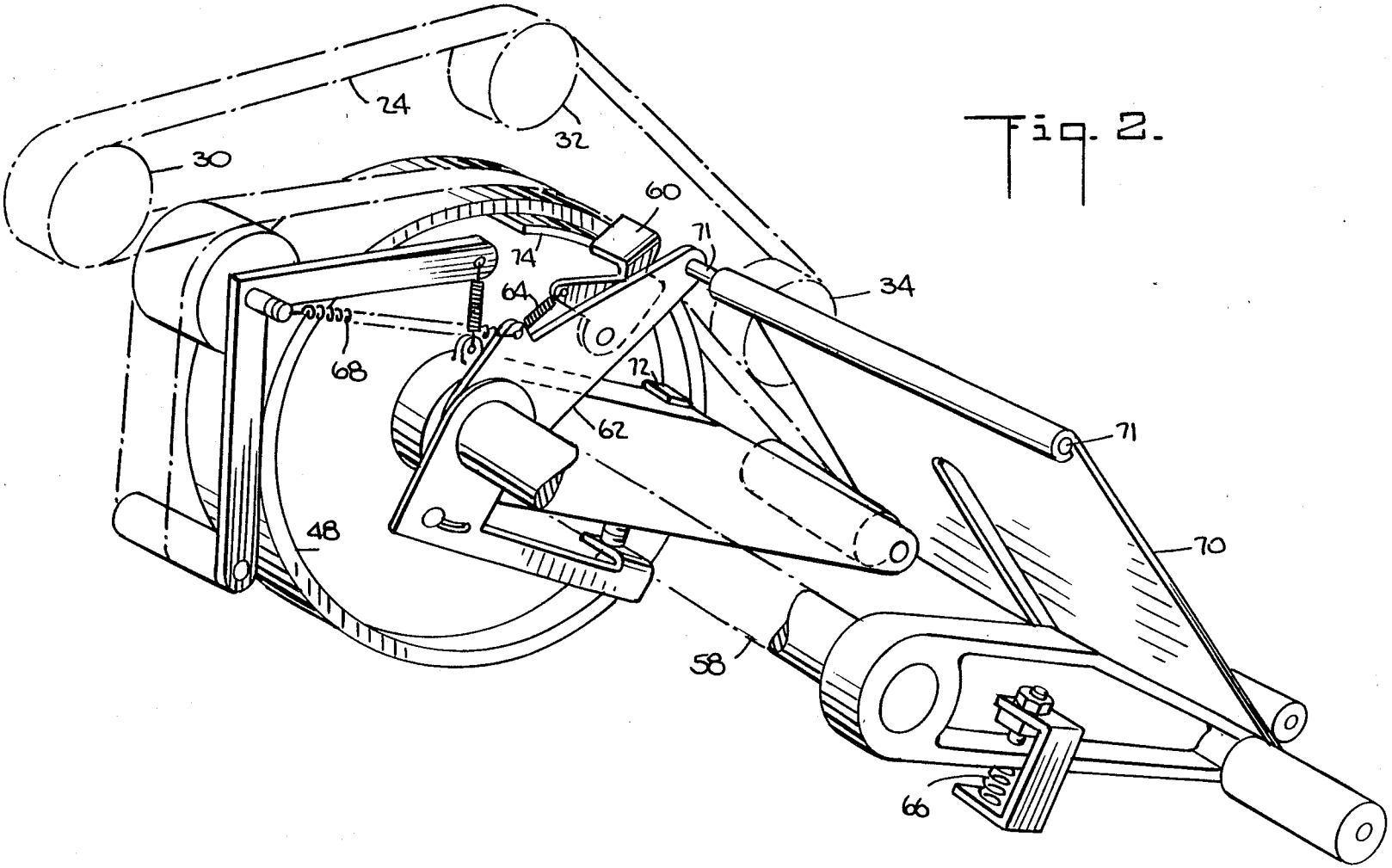
FIG. 2 is a perspective view of the interior of the inserting system seen in FIG. 1.
Figure 3:
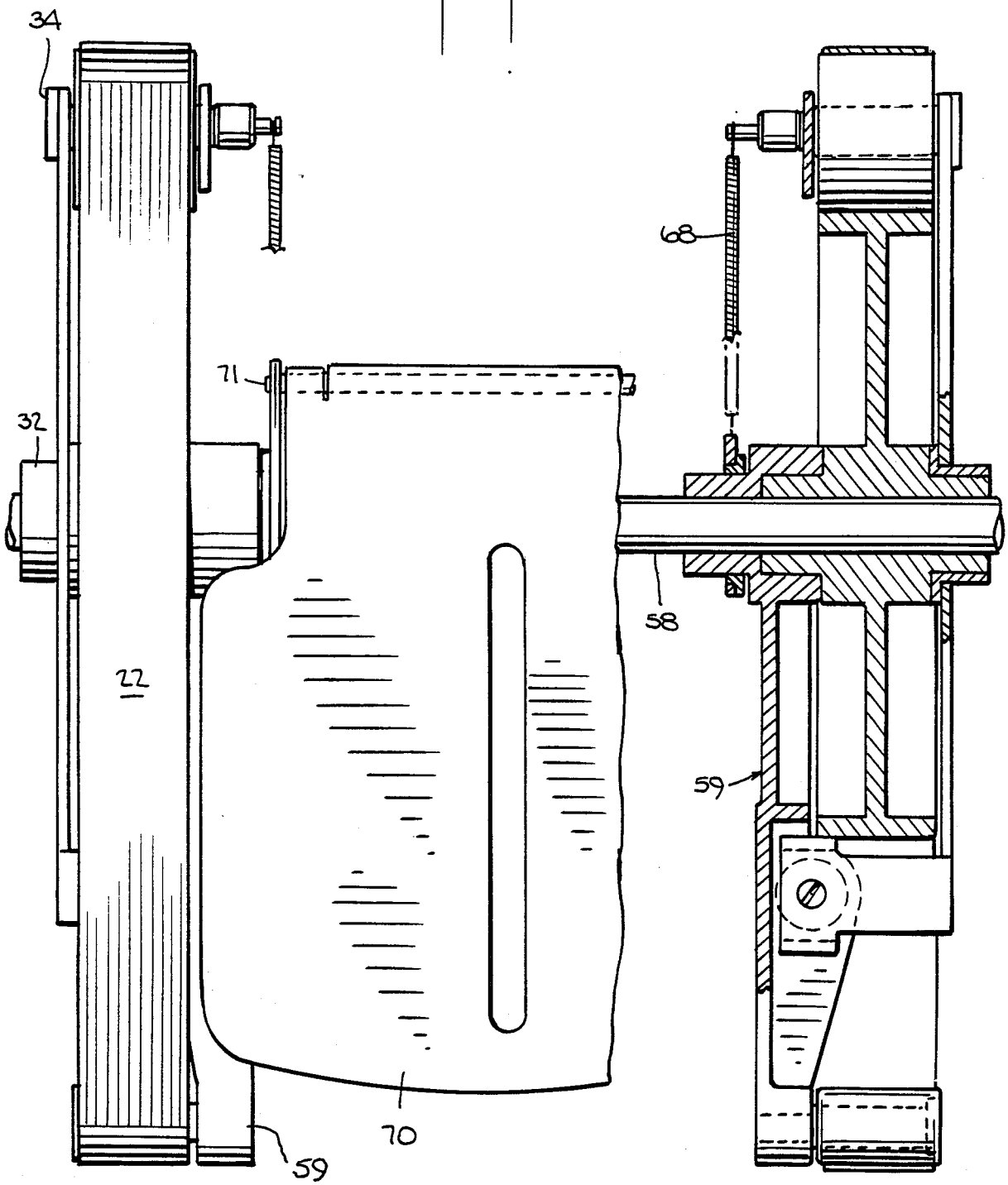
FIG. 3 is a top, plan view of the inserting system seen in FIG. 1.

The inserting system 10 further includes a pair of arm return springs 68, an envelope throat opening blade 70 pivotably mounted on a shaft 71 journalled to the ends of the arms 62, and a pair of trigger cam disengaging stops 72 which are mounted on the lower belt arms 59. In its home position, the blade 70 rests on the lower belt arms 59. Each of the trigger cams 60 includes an arcuate flange 74 (see FIG. 2) having a frictional pad that engages the inside of the respective rollers 44 and 48.

Figure 4:
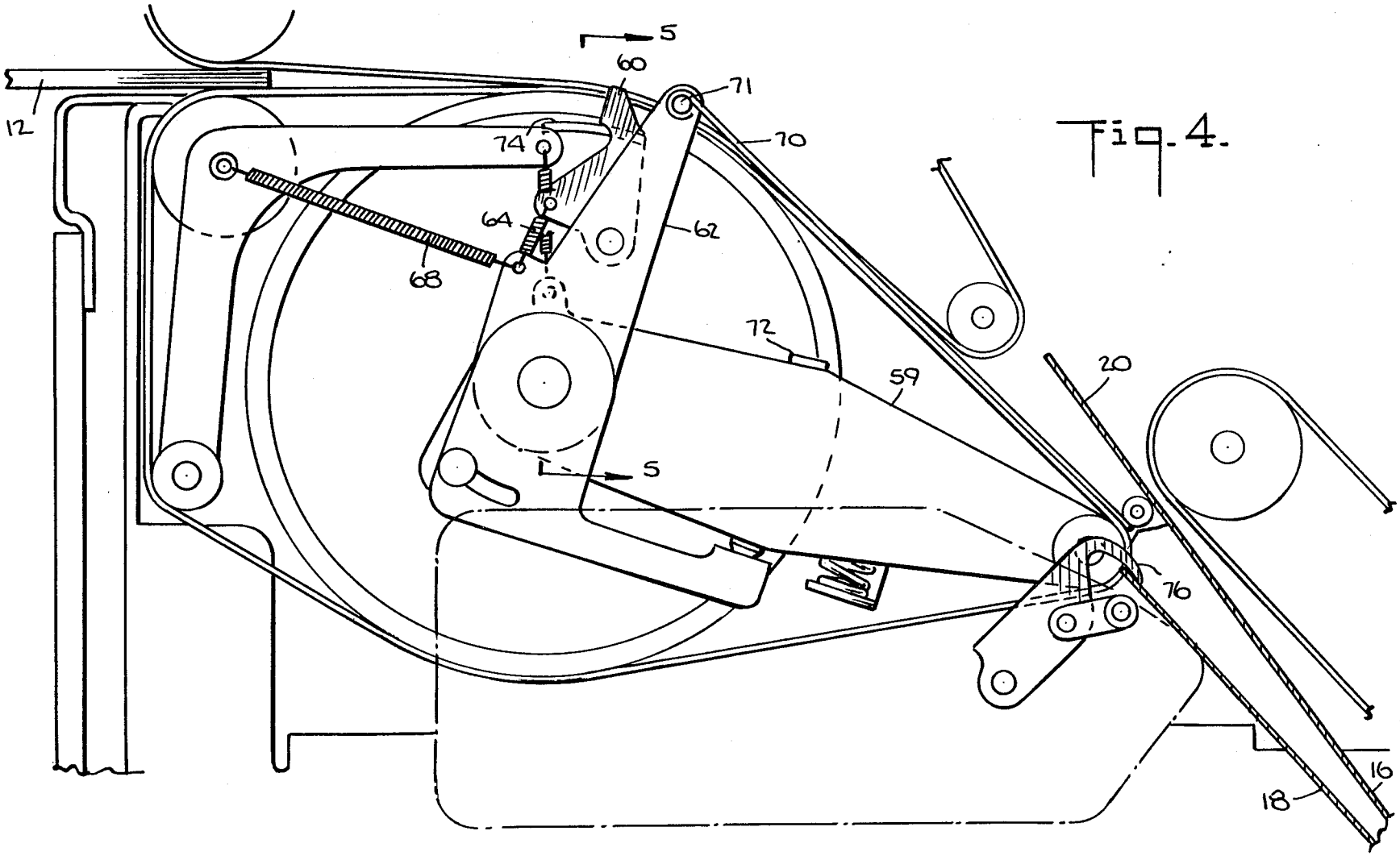
FIG. 4 is a side elevational view of the large roller and associated apparatus seen in FIG. 2, and shows the envelope throat opening blade in its home position and an envelope at the inserting station ready to receive documents.
Figure 7:
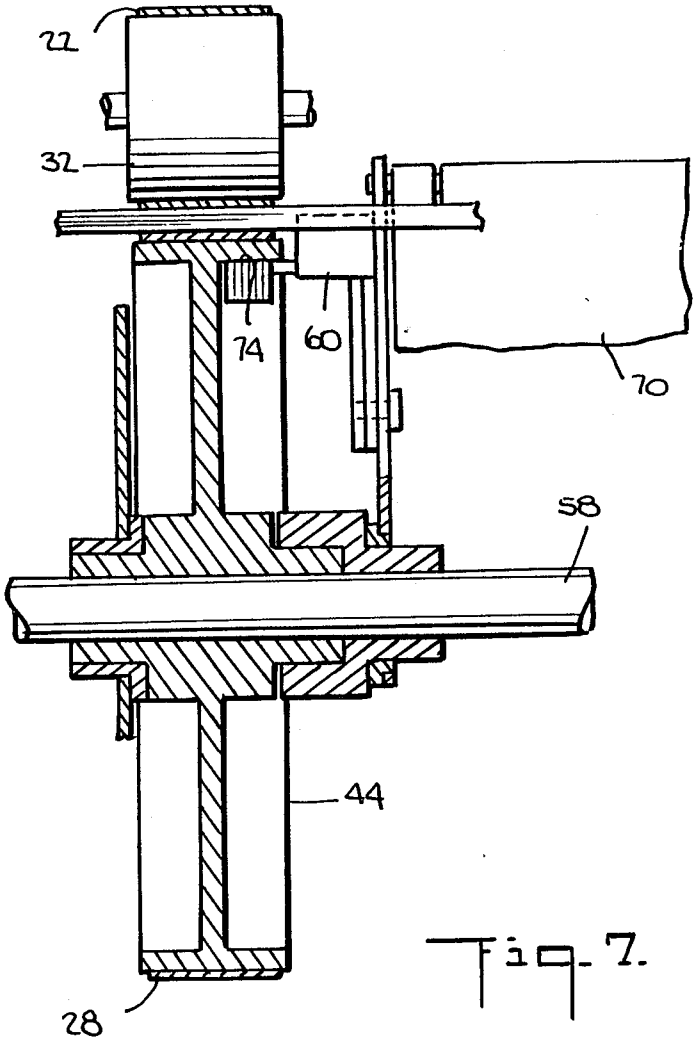
FIG. 7 is a sectional view taken on the plane indicated by the line 7—7 in FIG. 6.
Figure 5:
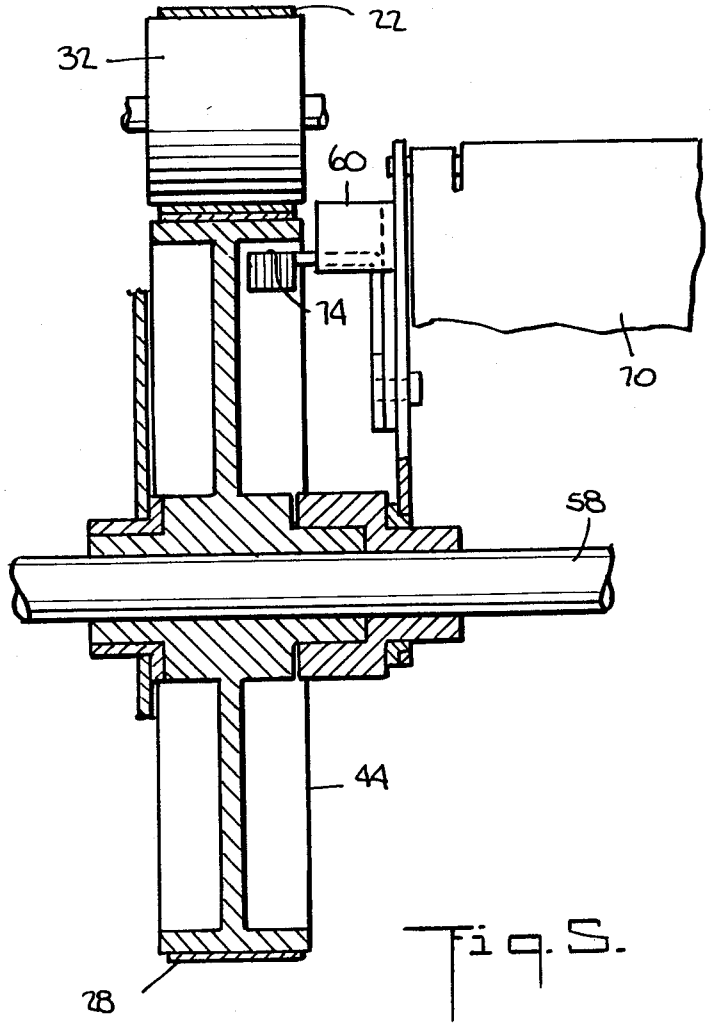
FIG. 5 is a sectional view taken on the plane indicated by the line 5—5 in FIG. 4.
Figure 6:
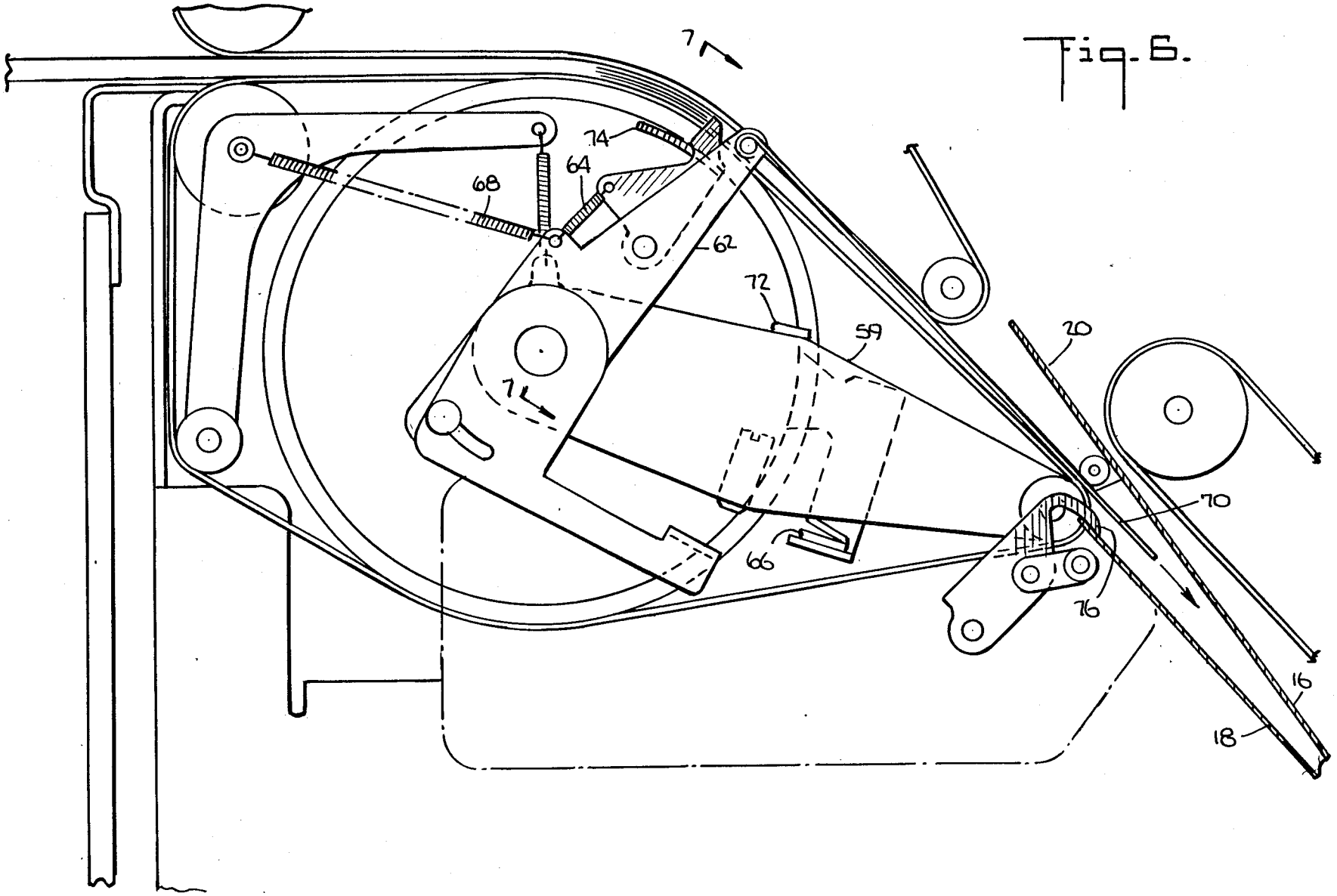
FIG. 6 is similar to FIG. 4 but shows the envelope throat opening, blade entering the envelope.
Figure 8:
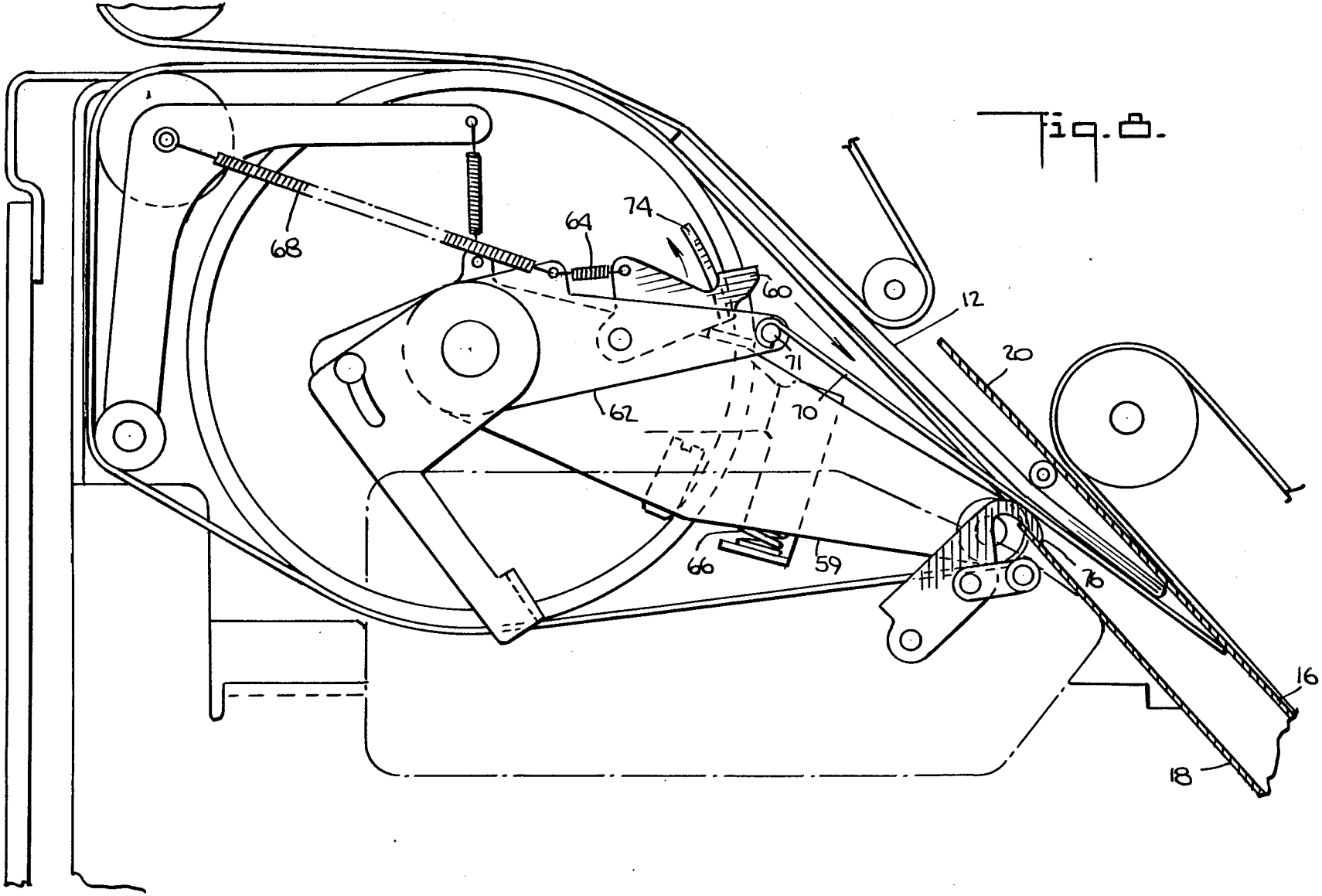
FIG. 8 is similar to FIG. 6 but shows the documents entering the envelope.

The operation of the inserting system 10 will now be explained. The collation 12 is fed from the document feeder (not shown) to the inserter 10 where it is held between the upper belts 22 and 24 and the lower belts 26 and 28. In its travel over the rollers 44 and 48, the collation 12 will necessarily hit the trigger cams 60 mounted on the arms 62. The cams 60 pivot so that their flanges 74 engage the interior of the rollers 44 and 48. The momentum of the constantly turning rollers 44 and 48 compels the arms 62 that are holding the blade 70 to rotate in the same direction as the rollers 44 and 48, thereby pushing the blade 70 into the envelope 14 until the mounting point of the blade 70 to the arms 62, i.e. the shaft 71, falls below the paper path, as seen in FIG. 8. It should be noted that a pair of opening claws 76 (described more fully in co-pending application no. Ser. No. 242,566 filed Sept. 12, 1988 in the name of David R. Auerbach for ENVELOPE OPENING APPARATUS) engage the back panel 18 of the envelope 14 prior to the blade 70 entering the throat of the envelope 14, as seen in FIG. 4.

When the shaft 71 falls below the paper path, the cams 60 hit the stops 72 which releases the cam flange 74 from the rollers 44 and 48. The cams 60 are then held remote from the rollers 44 and 48 by their return springs 64. As soon as the collation 12 has passed and is inserted into the envelope 14, the arm return springs 68 return the arms 62 to their home position (see FIG. 2) to await the next cycle of insertion.

From the foregoing description, it can be seen that the trigger cams 60 will be activated by all collations, and because the energy of the rollers 44 and 48 is used to drive the blade 70 into the envelope 14, it does not matter whether the collation 12 is heavy or light. The blade 70 serves to separate the back panel 18 from the front panel 16 of the envelope 14, so that it does not matter whether the envelope 14 is constructed from heavy or light paper; in either case the envelope is assured of being opened wide and thus obviating any possibility of damage to the envelope 14 by the collation 12.

It should be understood by those skilled in the art that various modifications may be made in the present invention without departing from the spirit and scope thereof, as described in the specification and defined in the appended claims.

What is claimed is:

1. Apparatus for inserting documents into an envelope, comprising:

a housing frame;

a constantly turning roller rotatably mounted to said frame;

a lower, rotatable belt mounted to said frame and trained over said roller, said lower belt having an upper reach;

an upper, rotatable belt mounted to said frame, said upper belt having a lower reach engagable with the upper reach of the lower belt to transport said documents;

means for separating the front wall from the back wall of the envelope, said means located on the downstream side of said upper and lower belts;

an envelope throat opening blade mounted to said frame on the downstream side of said upper and lower belts; and a pivotable trigger cam connected to said blade and engagable with said constantly turning roller and said documents, whereby when the documents engage said cam, said roller is engaged by said cam to thereby drive said opening blade into the throat of the envelope.

2. The apparatus of claim 1, wherein said separating means comprises a pair of opening claws which engage the back panel of the envelope.

3. The apparatus of claim 2, wherein said pivotable trigger cam is situated adjacent the top of the constantly turning roller.

4. The apparatus of claim 3, wherein said cam includes an arcuate flange for engaging the inside of the constantly turning roller.

5. The apparatus of claim 4, additionally including a cam return spring secured to said cam.

6. The apparatus of claim 5, additionally comprising an arm rotatably mounted to said housing frame, and wherein said blade and said cam return spring are secured to said arm.

7. The apparatus of claim 1, wherein said pivotable trigger cam is situated adjacent the top of the constantly turning roller.

8. The apparatus of claim 1, wherein said cam includes an arcuate flange for engaging the inside of the constantly turning roller.

9. The apparatus of claim 1, additionally including a cam return spring secured to said cam.

10. The apparatus of claim 1, additionally comprising an arm rotatably mounted to said housing frame, and wherein said blade and said cam return spring are secured to said arm.

* * * * *